United States Patent [19]

Elmiger et al.

[11] 3,988,923

[45] Nov. 2, 1976

[54] MEASURING DEVICE

[75] Inventors: Rochus B. Elmiger, Berlin; Harald Beck, Hamburg, both of Germany

[73] Assignee: H. Maihak A.G., Hamburg, Germany

[22] Filed: Mar. 20, 1975

[21] Appl. No.: 560,561

[30] Foreign Application Priority Data

Apr. 5, 1974 Germany ..... 2416647

[52] U.S. Cl. ..... 73/84

[51] Int. Cl.[2] ..... G01N 3/00

[58] Field of Search ..... 73/84, 85, 101, 9, 432 R

[56] References Cited

UNITED STATES PATENTS 3,481,188 12/1969 Mori ..... 73/84

FOREIGN PATENTS OR APPLICATIONS 983,514 5/1951 France ..... 73/84

1,095,398 5/1955 France ..... 73/84

*Primary Examiner*—Donald O. Woodiel

*Attorney, Agent, or Firm*—Michael J. Striker

[57] ABSTRACT

A measuring device for measuring peak pressure and skin friction in a substrate has a probe body which is to be driven into the substrate to be measured, a first detecting arrangement in the body and serving to detect peak pressures which develop as the body is driven into the substrate, a second detecting arrangement also in the body and operative for detecting skin friction which develops as the body is driven into the substrate, and separate conductors connected with the first and second detecting arrangement, respectively, for carrying signals which originate in the same.

11 Claims, 2 Drawing Figures

MEASURING DEVICE

BACKGROUND OF THE INVENTION

The present invention relates generally to a measuring device, and more particularly to a probe for conducting measurements in a substrate into which the probe is driven.

Still more specifically, the invention is concerned with a measuring probe for measuring skin friction and peak pressure in a substrate.

Measuring devices of the type in question are widely used for determining the characteristics of soil strata, especially those located relatively far from the surface. They employ a probe which is forced into the substrate, that is into the soil in this case, and which is provided with measuring arrangements. The user of such a probe can make deductions concerning the character of the soil strata, the consistency and the layering, from the force required to push the probe body through the soil, i.e., from the resistance of the soil to penetration. The total force acting upon the pressure measuring device of the probe is composed of the force acting lengthwise of the probe upon the tip at the leaading end thereof, and the skin friction acting upon surface portions of the probe. When both the local peak pressure and the local skin friction are jointly known, conclusions may be drawn concerning the soil characteristics, for example concerning the change of the soil characteristic from a looser to a more compact stratum, or vice versa.

Measuring devices for measuring the peak pressure that develops during the insertion of such probes are known. They may, for example, have a thin-walled cylindrical member the elastic compression of which—resulting from soil resistance to the insertion of the probe—serves as a measure of the resistance acting upon the tip of the probe. A sensor is used which measures the degree of compression and delivers an electrical signal which is supplied to a receiver. It is also known in the prior art to provide an arrangement measuring the total force required to push the probe into the soil. In other words, these devices measure the total force required to insert the probe and the peak pressure which develops, and by taking the difference of these two forces they derive a value for the skin friction acting upon the total probe which is composed of the probe body and the probe-inserting rods or the like.

This manner of determining the peak pressure and the skin friction has various disadvantages, not the least of which is the fact that it is complicated since skin friction is not measured directly, but as the difference of two values. This also means that the measurement of skin friction is inevitably subject to errors of an unacceptable magnitude. The measuring arrangement for measuring the peak pressure in these devices is located within the tip of the probe body. whereas the skin friction that is determined by taking the difference between the total inserting force and the peak pressure includes the skin friction which acts not only on the probe body but also upon the inserting rod or rods, so that the measured skin friction value is not the value applicable to the probe body alone, as it should be, but is increased by the value of the skin friction acting upon the inserting rod or rods; it is therefore inaccurate.

SUMMARY OF THE INVENTION

Accordingly, it is an object of the invention to provide an improved measuring device of the type in question which is not possessed of the aforementioned disadvantages.

In particular it is an object of the invention to provide a probe for measuring peak pressure and skin friction in soil, wherein both values are measured separately and independently of one another.

Such a device must meet a series of requirements. The sensors which sense peak pressure and skin friction must be located within the probe body, as far inwardly of the outer surface thereof as is practicable, since it is important to assure that the relatively high temperature gradients which develop at the outer surface of the probe body during the insertion into the substrate will influence the sensed values as little as possible. For this reason it is not practical to simply measure material-expansion values at the outer surface of the probe body, although this would be simpler, because to do so would result in incorrect values.

In order to be able to interpret the measured results in terms of the skin friction in correspondence with the particular soil characteristics, the skin friction between the probe body and the soil particles must be measured at a time at which the dislocation of the soil particles which is caused by the penetration of the tip of the probe body into the soil, is already substantially concluded and the soil particles have reoriented themselves to form a new stable soil structure; this requires that the measurement be taken at a certain distance rearwardly of the tip of the probe body, which distance should be relatively small.

Also, many types of soil have the characteristic that the passage created in the soil by the insertion of the probe body remains essentially unchanged in its cross sectional area, so that if a probe body has a diameter which is constant over its length, only small and insignificant skin friction values will be measured. The device according to the present invention must therefore be so constructed that it permits an improved measurement of the skin friction without causing new structural changes in the soil structure during withdrawal of the insertion of the probe.

The aforementioned requirements are met in the device according to the present invention which, briefly stated, comprises a probe body adapted to be driven into a substrate to be measured, first detecting means in this body and operative for detecting peak pressure which develops as the body is driven into the substrate, second detecting means also in this body and operative for detecting skin friction which develops as the body is driven in the substrate, and separate conductors connected with the first and second detecting means, respectively, for carrying signals originating in the same.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
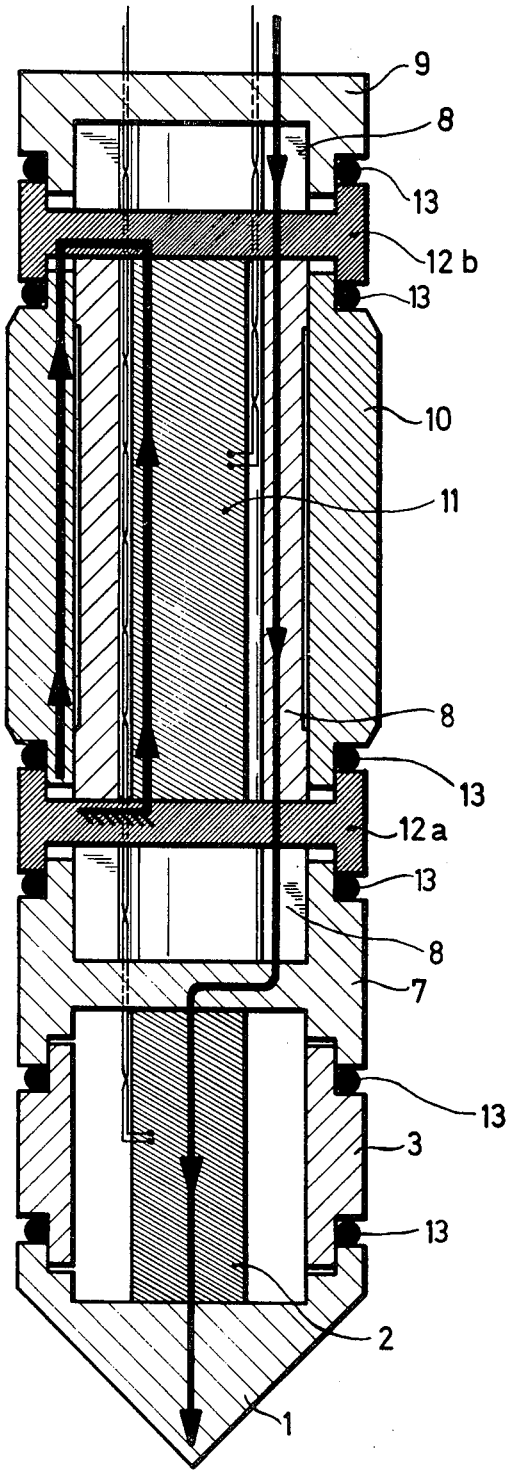
FIG. 1 is an axial section through a measuring device according to the present invention.

The probe body according to the present invention has a tip 1 with which it is to be driven into the substrate, for example, the soil. The driving is effected by applying a driving force via a non-illustrated instrumentality (e.g., a rod or other known driving instrumentality) to an end cap 9 from which it is transmitted without the aid of relatively slidable components to the tip 1 via a force transmission pipe 8, an intermediate member 7 and a pressure measuring sensor 2 which is located immediately rearward of the tip 1. The sensor 2, as well as the sensor 11 which will be described later and senses skin friction, are both known in the art and therefore require no detailed discussion. The sensor 2 may, for example, be of the type which uses wire strain gauges or the like; the soil resistance to penetration of the tip 1 causes the latter to be pushed against the sensor 2 which is, therefore, subjected to axial compression and which supplies an electrical signal whose magnitude is equivalent to the magnitude of the peak pressure acting upon the tip 1; this signal is produced in a manner known in the art. The transmission of the driving force via the end cap 9 to the tip 1 is identified by the arrow connecting these components.

The skin friction is measured via a sleeve 10 whose length is determined in dependence upon structural and measuring characteristics; the sleeve 10 is rearwardly spaced from the tip 1 via an intermediate member 7 and a protective annular member 3 both of which are interposed between the tip 1 and the sleeve 10. The skin friction sensor 11 which senses the magnitude of skin friction acting upon the sleeve 10 is located within the pipe 8; it is important that no component of the peak pressure be allowed to act upon the sensor 11 and that the latter is subject only to transmission of the skin friction information. For this purpose there is no force-transmitting connection between the tip 1 and the sleeve 10. The sleeve 10 is rearwardly spaced from the tip 1 by a certain distance and has an outer diameter that is slightly greater than the outer diameter of the remaining components making up the probe body—which is advantageously identical for all of these remaining components—; the outer diameter of the sleeve 10 may, for example, be approximately 0.3 mm larger than that of the remaining components. The sleeve 10 is insulated from the remaining components insofar as the transmission of peak pressure is concerned. This is achieved by arranging two disc-shaped members **12*a*, 12*b* at the opposite axial ends of the sleeve 10; these members are provided with two substantially semicircular recesses 15 (compare also FIG. 2) which extend parallel to their respective circumferences and which are separated by two diametrically opposite ribs 16 whose widths correspond the wall thickness of the tube or pipe 8**.

Figure 2:
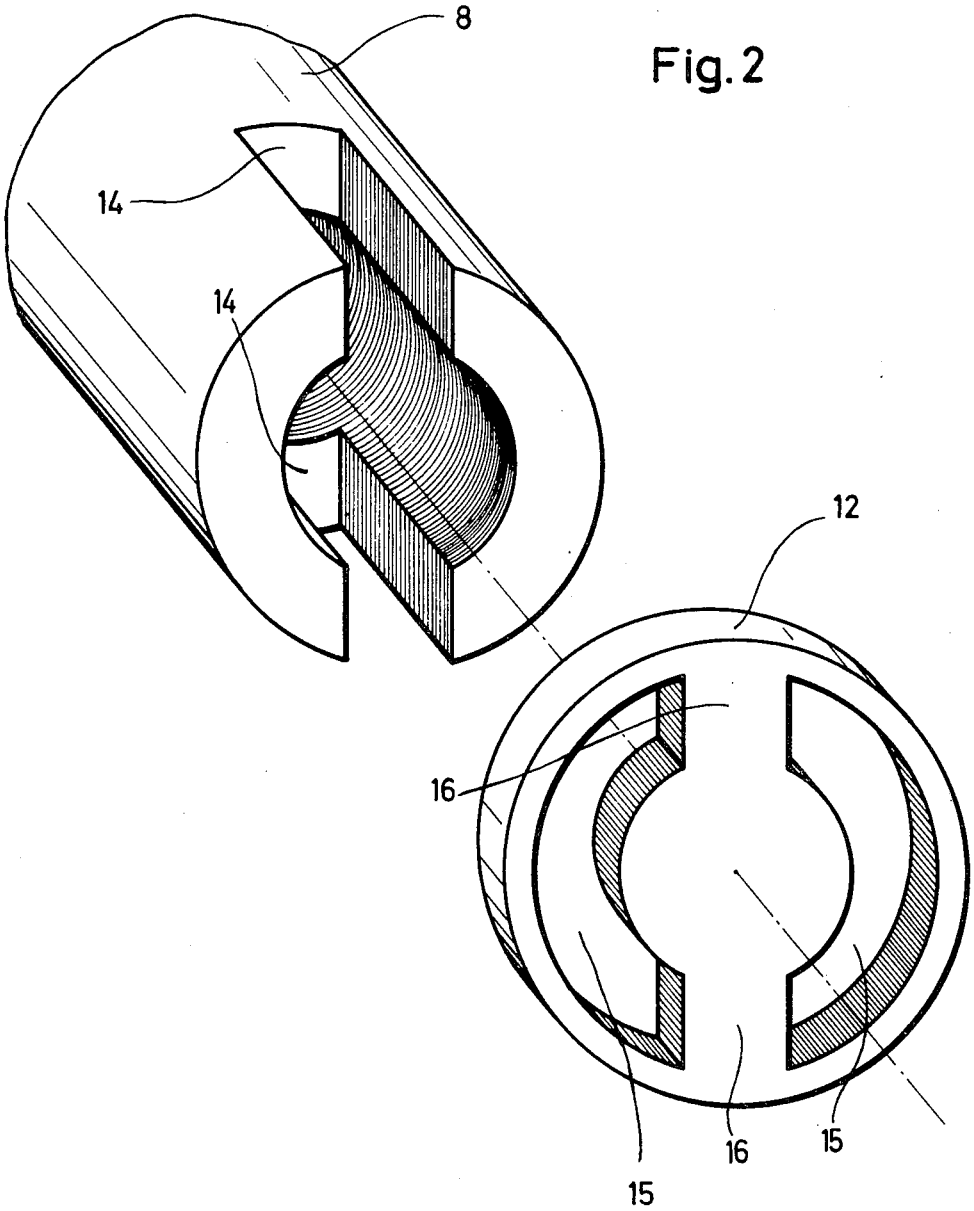
FIG. 2 is an exploded perspective showing a detail of the device in FIG. 1 on an enlarged scale.

When the probe body is inserted into the soil, the sleeve 10 is pushed against the member **12*b*; the sensor 11 is fixedly connected —e.g., screw threaded—with the members 12*a* and 12*b*; when the sleeve 10 is pressed against the member 12*b* it draws the member 12*a* against the contact face 14 of the pipe 8 which is slotted at its axial ends (see FIG. 2). In dependence upon the skin friction acting upon the sleeve 10, the sensor 11, wich may again be of the type provided with wire strain gauges or the like, is stretched and as a result produces an electrical signal whose magnitude is equivalent to the value or magnitude of skin friction acting upon the sleeve 10. The line of force transmission acting between the sleeve 10 and the sensor 11 is indicated by the arrow connecting the two components. Sufficient play must of course remain between the member 12*b* and the end cap 9** for this purpose, for example approximately 0.5 mm.

If the probe is subsequently drawn back out of the substrate, the sleeve 10 pushes against the member **12*a* and draws the member 12*b* via the sensor 11 against the upper end of the pipe 8. This again results in a stretching of the sensor 11 and the production of a signal indicative of the skin friction acting upon the sleeve 10**. This means both during the insertion and withdrawal of the probe a signal will by yielded.

Reference numeral 13 identifies sealing elements, such as O-rings or the like, which seal the interior of the probe body against the entrance of soil particles or other contaminants.

Due to the construction of the present device, it is now possible to measure the peak pressure and the skin friction values independently and separately from one another, and to exclude extraneous information tending to falsify the measured results, such as skin friction acting upon the driving rod used to insert the probe body into the soil.

It will be understood that each of the elements described above, or two or more together, may also find a useful application in other types of constructions differing from the type described above.

While the invention has been illustrated and described as embodied in a measuring device for measuring peak pressure and skin friction in soil, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a measuring device, particularly in a probe for measuring peak pressure and skin friction in soil, a combination comprising a probe body adapted to be driven into a substrate to be measured and having a leading end, a trailing end and a tubular member extending in a direction from said trailing end towards said leading end to transmit driving pressure to said leading end; first detecting means in said body and operative for detecting peak pressures which develop as said body is driven into the substrate; second detecting means also in said body and operative for detecting skin friction which develops as said body is driven into the substrate, said second detecting means including a skin-friction sleeve having an outer sleeve diameter which exceeds the maximum outer diameter of any other component of said body; and separate conductors connected with said first and second detecting means, respectively, for carrying signals originating in the same.

2. A combination as defined in claim 1, said first detecting means being located adjacent said leading end; and wherein said skin-friction sleeve is located rearwardly of said first detecting means.

3. A combination as defined in claim 2, wherein said sleeve at least in part surrounds said tubular member.

4. A combination as defined in claim 1, said leading end having a forwardly convergent conical tip; and wherein said sleeve is rearwardly spaced from said tip by a preselected distance.

5. A combination as defined in claim 1, wherein said second detecting means comprises a skin-friction detector located within said tubular member and operatively connected with said sleeve.

6. A combination as defined in claim 1, wherein said body is pressure-tight and soil impervious.

7. A combination as defined in claim 1, wherein said sleeve diameter exceeds said maximum diameter by an amount on the order of 0.3 mm.

8. A combination as defined in claim 1, said second detecting means comprising a skin-friction detector; and wherein said sleeve is mounted so as to be movable relative to said tubular member in response to the generation of skin friction at said sleeve, and said detector is arranged to sense the relative movement of said tubular member and said sleeve.

9. In a measuring device, particularly in a probe for measuring peak pressure and skin friction in soil, a combination comprising a probe body adapted to be driven into the substrate to be measured, said body having a leading end and trailing end and including a tubular member extending from said trailing towards said leading end to transmit driving pressure thereto, said trailing end including a portion adapted to have driving force exerted upon it for transmission to said leading end; first detecting means in said body and operative for detecting peak pressures which develop as said body is driven into the substrate; second detecting means also in said body and operative for detecting skin friction which develops as said body is driven into the substrate, said second detecting means including a skin-friction sleeve located rearwardly of said first detecting means and surrounding said tubular member; and separate conductors connected with said first and second detecting means, respectively, for carrying signals originating in the same; and a pair of ring elements located axially adjacent to the respective axial ends of said sleeve for insulating the same against direct force transmission from said portion of said trailing end.

10. A combination as defined in claim 9, each of said ring elements being formed with two substantially semicircular recesses parallel to its circumference, said recesses being separated by ribs which are located between their juxtaposed ends and which have a width corresponding to the wall thickness of said tubular member.

11. A combination as defined in claim 10, said tubular member being formed with two diametrically opposite slots having a width equal to said width of said ribs and being bounded by abutment surfaces.

* * * * *